US006612436B1

(12) United States Patent
Zullo

(10) Patent No.: US 6,612,436 B1
(45) Date of Patent: Sep. 2, 2003

(54) PORTABLE STORAGE CONTAINER

(76) Inventor: Emilio Zullo, 493 California Rd., Eastchester, NY (US) 10708

( * ) Notice: Subject to any disclaimer, the term of this patent is extended or adjusted under 35 U.S.C. 154(b) by 0 days.

(21) Appl. No.: 10/256,961

(22) Filed: Sep. 27, 2002

(51) Int. Cl.[7] ..... B65D 85/66
(52) U.S. Cl. ..... 206/391; 206/409; 206/419
(58) Field of Search ..... 206/380, 389, 206/391, 392, 394, 403, 408, 409, 418, 419; 242/588.3, 588.5, 588.6, 514.6, 900

(56) References Cited

U.S. PATENT DOCUMENTS 3,443,736 A * 5/1969 Steinbock ..... 206/391
4,369,929 A * 1/1983 Cayer ..... 206/391
4,730,778 A * 3/1988 Akao et al. ..... 242/588.5
4,998,685 A * 3/1991 Spencer ..... 206/409
5,040,708 A * 8/1991 Blair et al. ..... 206/391
5,344,014 A * 9/1994 Toral et al. ..... 206/394
5,346,065 A * 9/1994 Dunbar et al. ..... 206/391

* cited by examiner

*Primary Examiner*—Luan K. Bui
(74) *Attorney, Agent, or Firm*—Thomas A. Beck

(57) ABSTRACT

A carousel suitable for storing dolls having a plurality of compartments with doors opening into each compartment and a top storage above the compartments with doors that cover the storage space and for the top of the carousel.

4 Claims, 6 Drawing Sheets

PORTABLE STORAGE CONTAINER

BACKGROUND OF THE INVENTION

1. Technical Field of the Invention

The present invention relates generally to a portable assembly suitable for storing a plurality of lineally connected items on spool-like means therein. More particularly, the present invention relates to a structural unit which stores a plurality of individual spools which contain at least one set of linear elements such as chains or Christmas tree lights. The unit also has a separate compartment located in its top having additional storage space for accessories such as chain cutting means or Christmas tree bulbs.

2. Description of the Related Art

In the prior art, the usual method for storing a string of Christmas tree lights comprised removing the string of lights from the tree, and forming a circular loop with the string and then securing the circular loop with means to insure that the loop would not unravel. Alternatively, the string of lights is wrapped around cylindrical means so that the line of tree lights are wrapped tightly around the external surface of the cylindrical means with the proximal and distal ends of the string of lights secured to the cylinder to insure that the string of lights does not unravel. The problem with these prior art methods is that the string of lights can be easily tied up and stored, but when they are to be used again, the string of lights can unravel and get entangled so that one wastes a considerable amount of time just straightening out the string of lights much to the irritation of the user.

The object of the present invention is to provide a portable carrying case that allows one to easily remove strings of lights from holiday settings, to wind them onto a spool and then to store same until the next time they are needed. Another object is to coordinate the structure of the container with the activity such that the string of lights can be wound through a vertical opening in one side of the container directly onto a spool with is positioned within the interior of the container. When the spool is fully wound, it is then stored on a spool post with in the container. Other objects and features as well as additional details of the present invention will become apparent from the following detailed description and annexed drawings of the presently preferred embodiments thereof, when considered in conjunction with the drawings.

SUMMARY OF THE INVENTION

The present invention relates to a portable storage container. For the purpose of explication of the present invention, the container will be described demonstrating the storage of strings of Christmas tree lights, however the invention is equally applicable to other uses such as the storage of strings, chains, rope or electrical wire of different gauges. The container of the present invention is formed from a base and four side walls extending upwardly from and surrounding the base and conforming to the shape of the base. The base thus defines the peripheral configuration of the container.

Each segment of the side wall has an exterior face, an interior face, is of identical height, and has a bottom edge positioned adjacent said base. The container may be square or rectangular in shape so the sidewalls may be the same width, in the case of a square dimensional base or two of the sidewalls may be wider than the other two sidewalls as in the case of a rectangular dimensional base.

Within the interior walls of the container, extending upwardly from the base there are a plurality of spool posts that are fixed to the base. Each spool post is encircled by a rotatable disc which supports a spool when the opening of the spool is placed on the spool post. The container has a top which is hingedly affixed to the rear side of the container. The top has compartments formed therein for storage of accessories used in conjunction with whatever is being stored on the spools in the container.

Thus the invention relates to a storage container having a bottom section and an upper section, wherein the bottom section comprises a base and a plurality of walls extending upwardly from the base, each wall having a bottom edge positioned adjacent to and connected to the base, and having side edges which are in juxtaposition to side edges of other walls to form a rectangular shaped cavity in combination with the base, each of the side edges of said walls being fixedly attached to the edges juxtaposed thereto and each having a top edge. The walls and base are so formed to envelope a storage volume in the interior of said bottom section. The upper section has walls that correspond to in the shape of and contact said top edge of the bottom section.

The bottom section and the upper section are affixed to each other by hinged means along a common side of one of said upper section and said bottom section to allow the upper section to close over and be fixed to the bottom section, there being means for securing the upper section to said bottom section.

Within the interior of said bottom section, there are a plurality of stationary storage posts which extend upwardly from said base of said bottom section. Each storage post accommodates a plurality of spools around which flexible wire filaments are wrapped. The spools have a core diameter which allows one or more of them to be stored on said storage post;

One side of said walls of the bottom section has a vertical slit comprising two edges fitted with guide means, said vertical slit allowing direct passage from said interior of said bottom section to the outside and vice versa.

There is a retrieving post having a rotatable base positioned diametrically opposite said vertical slit which also accommodates a spool and is used to receive a rotating'spool while a flexible wire filament is wound up on said spool as a result of rotating said spool on said rotatable base, said wire having been wound on said spool as it was extended from said outside through said vertical slit onto said spool.

As noted, the spools of the present invention can be used to store any kind of flexible filament or wire in addition to the preferred use of a storage unit for Christmas tree lights.

DETAILED DESCRIPTION OF THE PRESENTLY PREFERRED EMBODIMENTS

Figure 1:
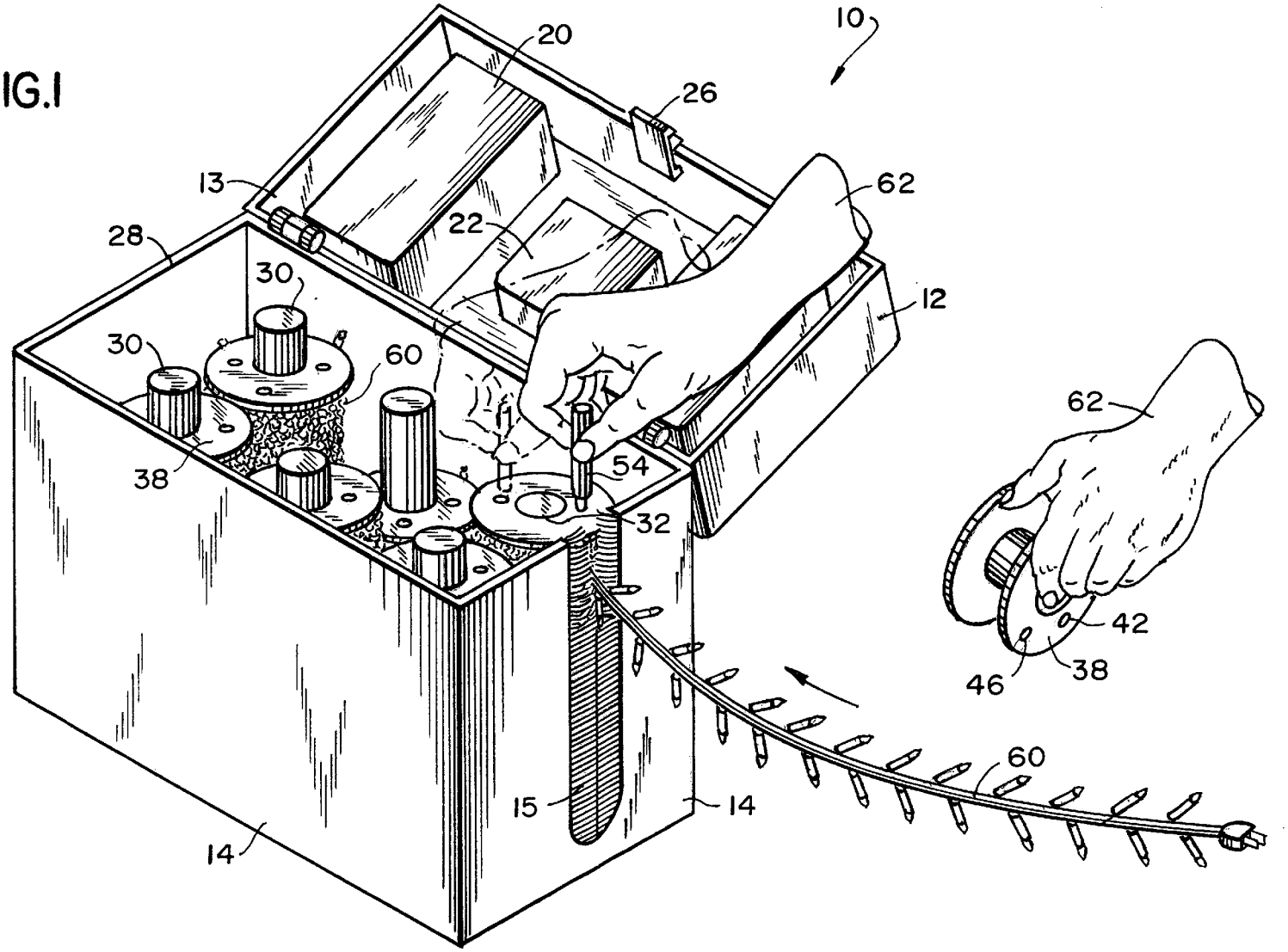
FIG. 1) is a perspective view showing a preferred embodiment of the invention.
Figure 4:
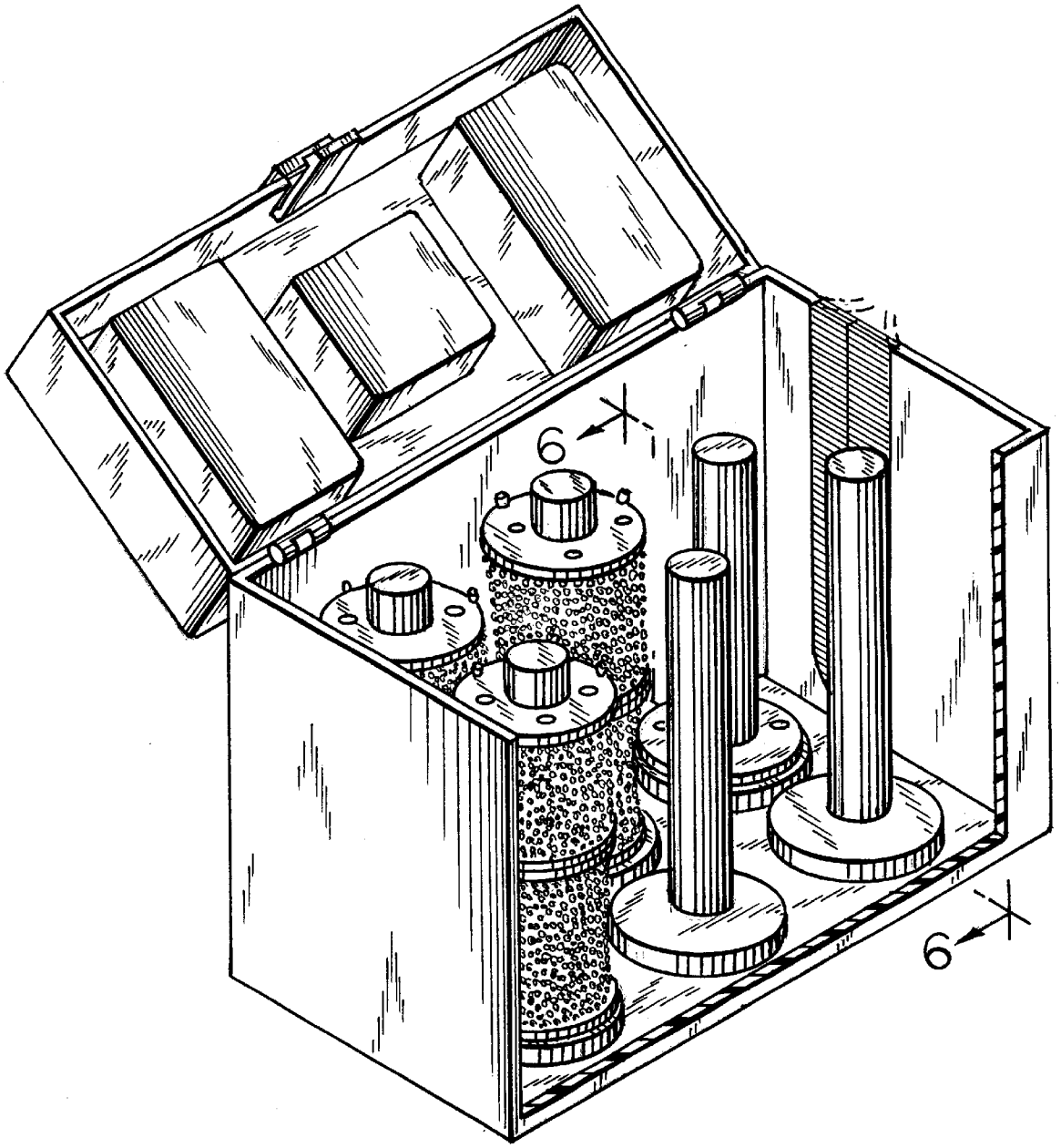
FIG. 4) shows a cutaway perspective view of the container depicting two storage posts and the receiving post.

Referring to the drawings, FIG. 1 depicts the Christmas tree lights organizer 10 of the present invention with its top or lid 12, hinges 13 which connect top 12 to sides 14 and 140 of the container. Side 140 contains a vertical opening 15 therein. Opening 15 is filled with a guide brush 150. Guide brush 150 comprises a set of opposing bristles, the loose ends of which meet one another and extend along the length of opening 15. There are six spool posts 30 situated within the spool compartment 28 within the container which extend upwardly from the base of the container. FIG. 1 shows five storage posts 30. These are posts upon which storage spools 38 are stored. Spools 38 are essentially reels in that they are revolvable devices on which something flexible is wound. In the case of the present invention, the flexible string of Christmas tree lights are wound on a spool 38. Storage posts 30 each have a circular disc-like base (not shown in FIG. 1) which is of suitable diameter to support horizontally a side of spool 38. Spool 38 can be of varying dimensions. As depicted in FIG. 4, spools 38 can be stacked on top of each other.

In addition to storage posts 30, there is also a retrieving post 32 which has a rotatable base that allows the Christmas tree light string 60 to be rotatably wound onto a storage spool 38 while storage spool 38 is mounted on retrieving post 32.

Figure 10:
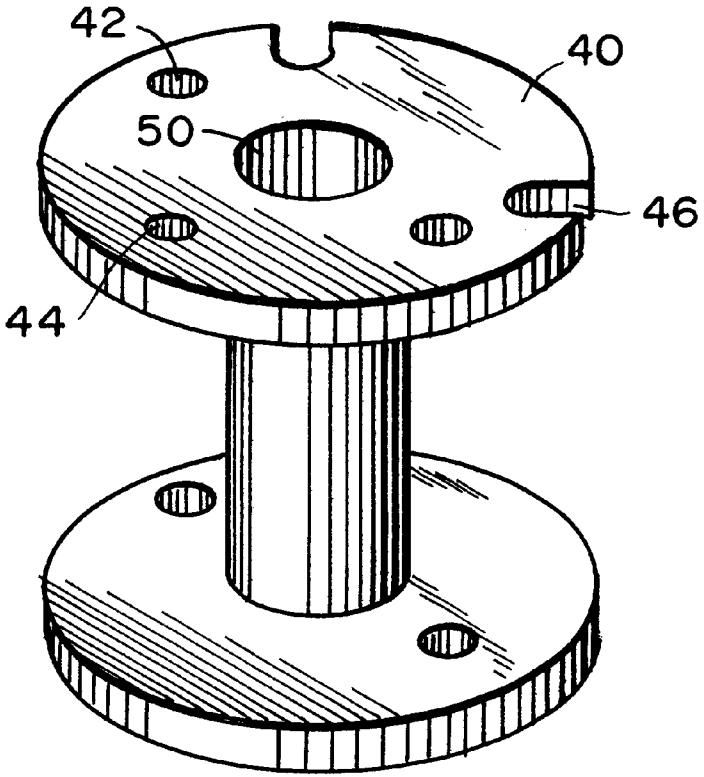
FIG. 10) shows the top of the Christmas tree light spool with female locking means.
Figure 9:
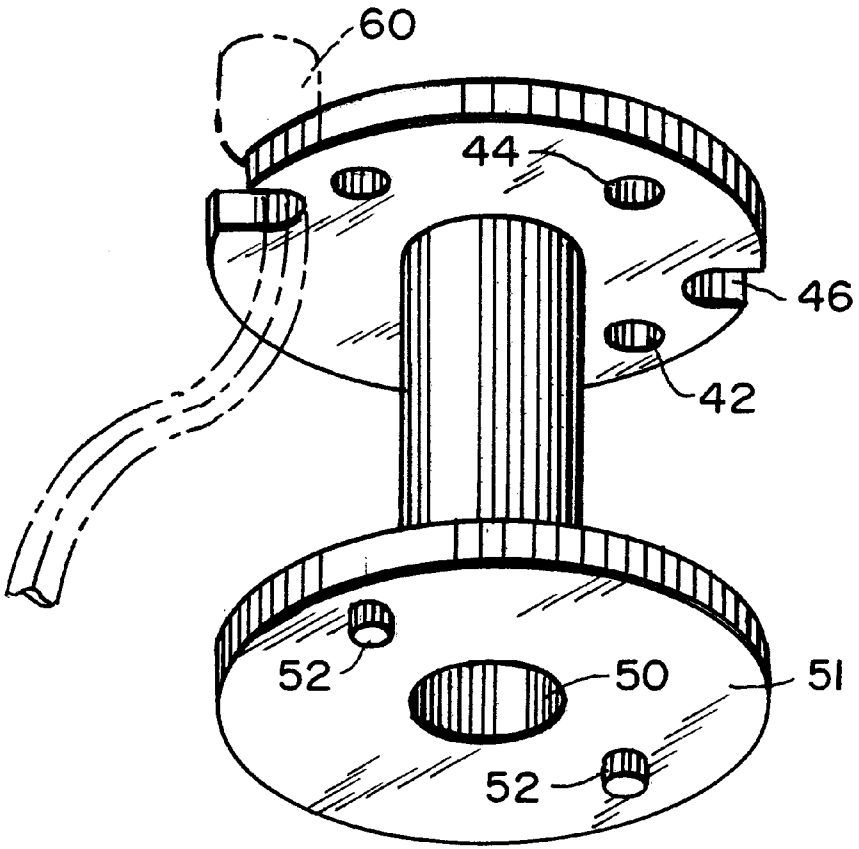
FIG. 9) is a bottom view of the Christmas tree light spool with locking tabs taken along lines 9—9 shown in FIG. 5.

FIGS. 9 and 10 depict the spool 38 used in the present invention. FIG. 9 shows the spool from the bottom perspective and depicts the center spool cavity 50 and the lower male locking tabs 52 on lower storage spool disc 51. FIG. 9 also depicts the underside of the upper storage spool disc 40 showing upper female locking opening means 42 and a handle locking opening (hole) 44. Aperture 46 is an opening designed to receive a cranking handle (not shown but visible in FIG. 1). The aperture opposite aperture 46 is is essentially a slot which is cut into the upper storage spool disc to hold and retain one end of the Christmas tree light string in place (shown) prior to winding same around the spool for storage.

FIG. 10 shows the top surface of upper storage spool disc 40. It contains upper female locking means opening 42, center spool cavity 50 and aperture 46 which is used to secure the lights in place prior to winding around the spool.

FIG. 1 shows the hand of the user 62 grasping cranking handle 54 and inserting same into handle locking hole in the spool for the purpose of rotating the storage spool and winding Christmas tree lights 60 through guide 15 which straightens out the line of lights prior to being secured to the spool. In the side view in FIG. 1, the user 62 is holding storage spool 38 which contains aperture 46 for securing the line in place and upper female locking means comprising an opening. The side view of FIG. 1 provides a more detailed view of the spool that is used in the container in FIG. 1.

After spool 38 can no longer contain any more length of Christmas tree light string, spool 38 is removed and placed on a spool post 30 where it is retained until it is next needed for decoration purposes. In FIG. 1, spool post 30 contains spool 38 which contains lights 60 wrapped therearound for storage.

Figures 2, 3:
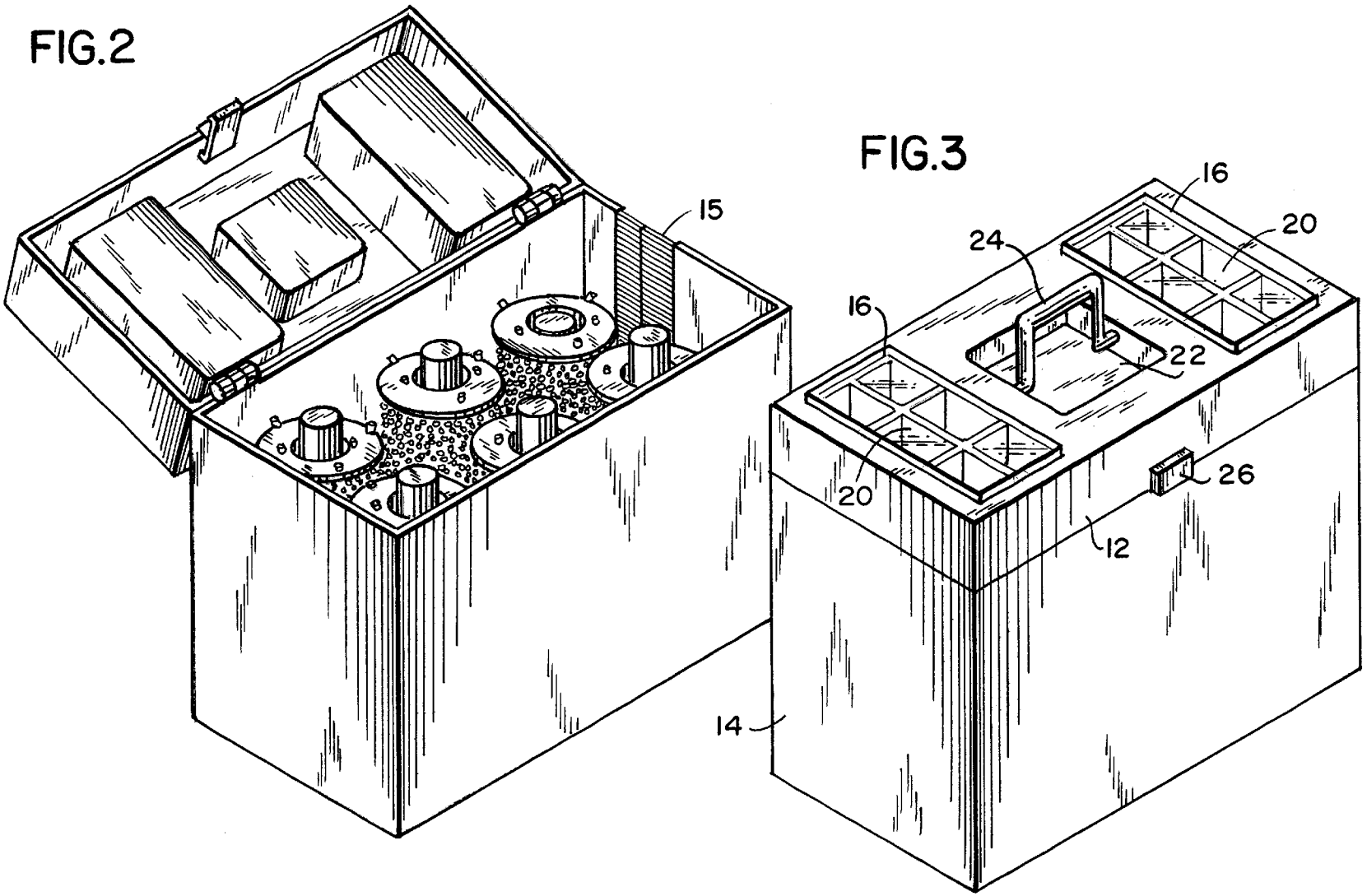
FIG. 2) shows a perspective view of the container open and full.
FIG. 3) shows the container closed and shows the top storage compartments.

FIG. 2 shows the container of the present invention with the top open and the compartments positioned therein. Within the walls of the lower portion of the container are the five spool posts with spools placed thereon each containing the Christmas tree lights wrapped around them, In addition, retrieving post 32 is positioned adjacent the opening containing the guide brush and also has a spool with Christmas tree lights wrapped about it.

FIG. 3 depicts organizer case 10 with its lid 12 closed. There are two recessed compartments 20 which may contain dividers to further divide up the space within the compartment. The each compartment is covered with a lid 16. There is also a recessed compartment 22 which contains handle 24. Handle 24 is swivelled so that it can be stored within handle recess compartment 22 thereby providing a smooth top surface so that organizers can be conveniently stored on top of each other. Lid lock 26 is provided to insure that top 12 can be fixedly secured to bottom section 14.

FIG. 4 depicts a perspective view of organizer case 10 with the front wall of the case partially removed to reveal the arrangement of spool posts 30, embodiments with two spools having Christmas tree lights wrapped about each of the spools, two spool posts 30 with their bases 301, and retrieving post 32 with its stationary base 301 and rotatable base having ball bearing guide means 33. Retrieving post 33 is diametrically opposite vertical opening with guide brushes 15. This positioning allows the user to place a storage spool (not shown) on the retrieving post and directly wind the Christmas tree lights (not shown) on to the spool by rotating same. The vertical opening with guide brushes insures that the wire remains in a straight line prior to being wrapped around the spool and thus it is not entangled or snarled thereby making the winding process straightforward and simple.

Figure 5:
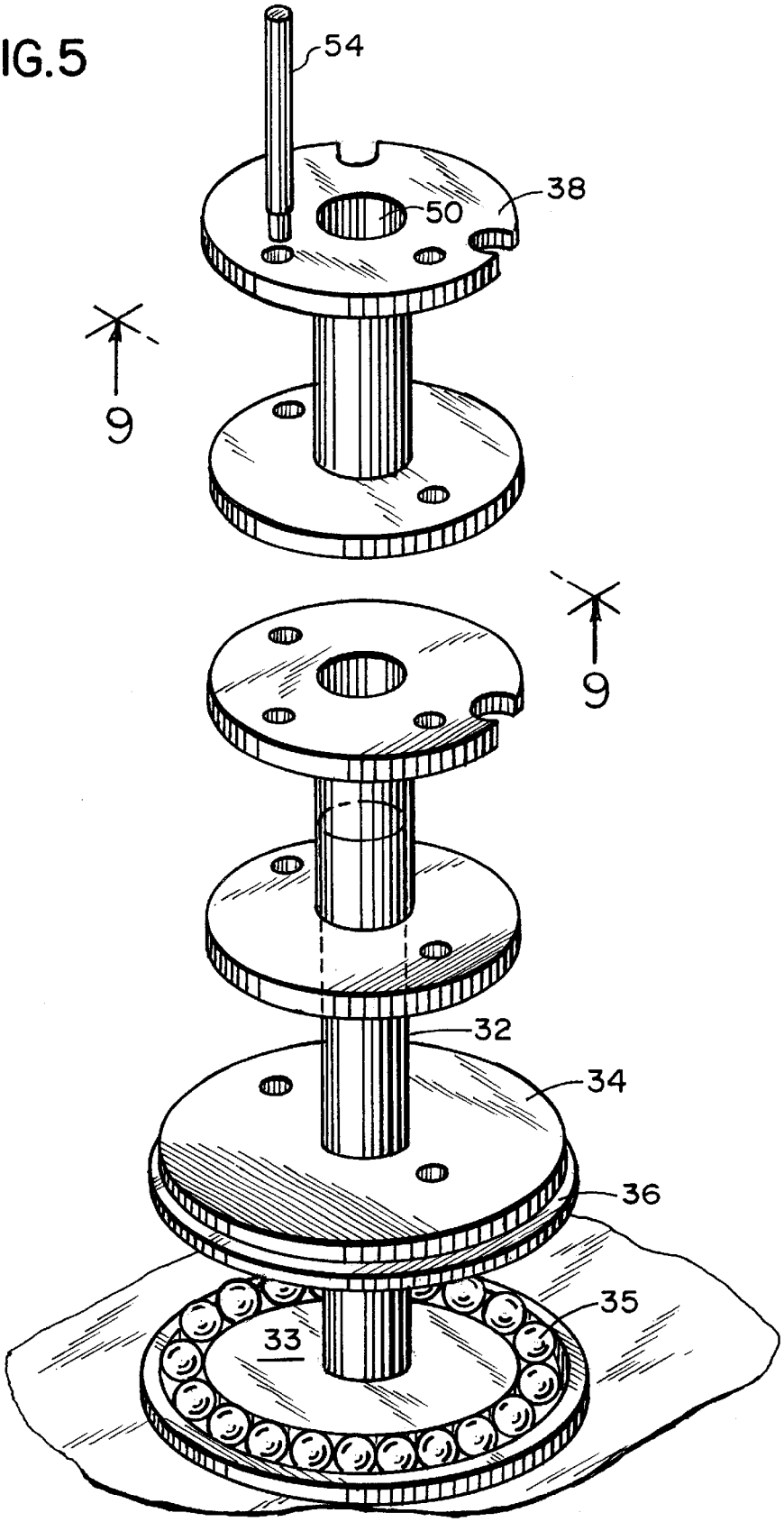
FIG. 5) is an exploded view showing receiving post with ball bearings, ball bearing guide track and a stationary base.

FIG. 5 is an exploded view of a retrieving post 32 with two spools 38 stacked one on top of the other. Top spool 38, has center spool cavity 50, aperture 46, handle locking hole 44, and shows cranking handle 54 above locking hole 44. Upper locking means 42 is a depression in the surface of upper storage spool disc 40 which is designed to align with lower male locking tab 52 (not shown). A stationary base 33 surrounds the bottom base of retrieving post 32. Resting upon stationary base 33 is ball bearing means comprising an inner race 70, balls 33 and outer race 71. Rotating plate 34 is connected to a top surface plate 56 covering the ball bearings by means of male locking tabs positioned on the underside of rotating plate 34 and corresponding upper female locking opening means such that when all of the spools are in place and the top spool is cranked with cranking handle 54, the entire assembly along the vertical axis including spools 38, rotating plate 34 and top surface plate 56 of the ball bearing assembly rotates. In the ball bearing, the area of contact between balls 35 and the moving parts is very small and friction is very low. This allows an easy rotation of spool 38 when the string of Christmas tree lights is wound onto the spool using cranking handle 54.

Figure 6:
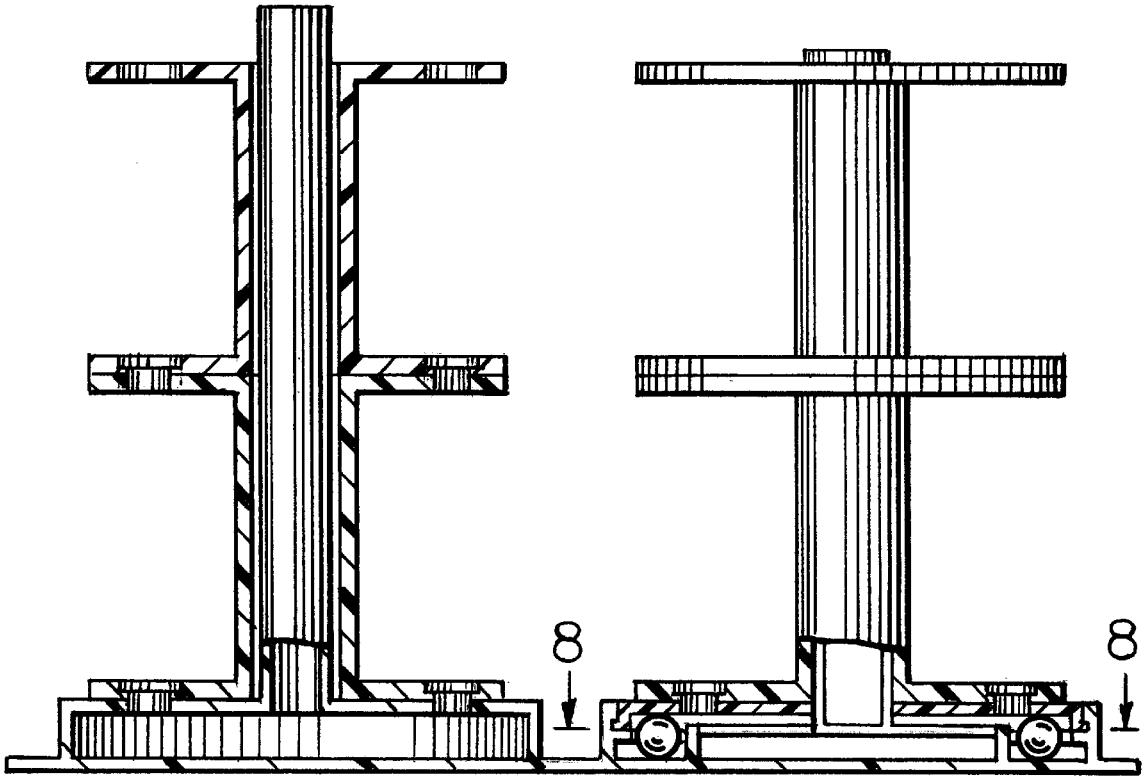
FIG. 6) is a cross section and elevation view showing a storage post and a rotating or receiving post taken along lines 6—6 shown in FIG. 4.

FIG. 6 is a cross sectional view of the spool post with spools placed thereon and the retrieving post with spools placed thereon. FIG. 6A depicts a cross sectional view of spool post with spools 38 stacked thereon. Upper (female) locking means 42 and lower (male) locking tabs 52 are shown. FIG. 6B is a cross sectional view of retrieving post 32 with the base cut away to show rotating plate 34, top surface plate 56 of the ball bearing assembly, inner race, outer race and balls 35. The connection between lower male locking tab located on the underside of rotating plate 34 and upper female locking openings situated on the top surface of plate 56 of the ball bearing assembly is depicted.

Figure 7:
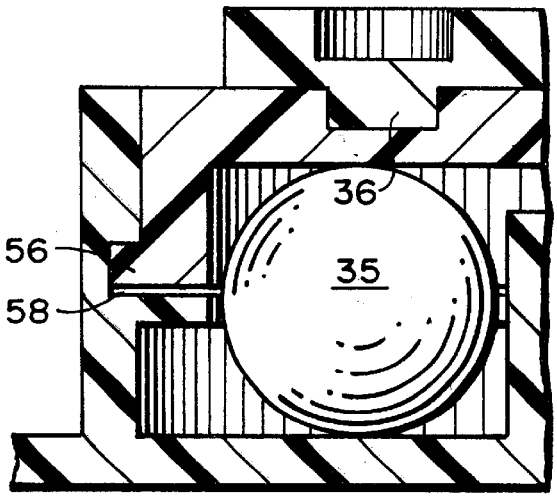
FIG. 7) is a cross sectional view of rotating means.

FIG. 7 is a cross sectional view of rotating means showing rotating locking means 36, ball bearing race 56, track 58 within which the ball bearings move and ball bearing 35.

Figure 8:
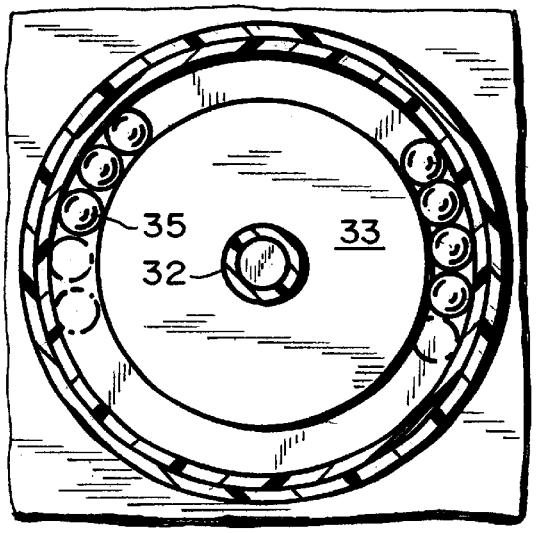
FIG. 8) is a plan view of bearings, bearing guide means, receiving post and stationary base taken along lines 8—8 shown in FIG. 6.

FIG. 8 is a top view of retrieving post 32, ball bearings 35, bearing races 33, 331, and receiving post stationary base 3.

FIG. 9 depicts the bottom of storage spool 38 with locking tabs 52. FIG. 10 shows the top of storage spool 38 with female locking means 42. The figures are discussed in greater detail hereinabove.

When the holiday season is over, a person who wishes to store the string of Christmas tree lights, or outdoor lights, etc., will remove the lights from their position and will take a spool and will secure one end of the light string to the spool by fixing the end to the notch cut into the edge of the spool so that the string is held securely by the spool. The spool is then placed upon the retrieving post (with the string of lights in place) and the locking tabs on the bottom side of the spool are inserted into the upper female locking means on the upper surface of the rotating plate. With the spool in place in the storage case, the string of lights is extended through the vertical slot having the guide brushes and the string of lights spread out therefrom. The cranking handle is inserted into the handle locking hole on the top surface of the spool and the spool is rotated by turning it with the crank handle. The retrieving post has ball bearing means at the base thereof so it is easily rotatable. As a result of the turning, the string of lights will be advanced through the guide brushes which will straighten out the string of lights and keep them taught as it is wound around the spool. When the spool is fully wrapped, the spool is removed from the retrieving post and the trailing edge of the string of lights is secured in the notch cut into the spool on the opposite side of the spool from the first notch mentioned above. The spool is then placed on a spool post for storage. The operation is continued until all of the lights have been wrapped around the spools. If the bulbs are to be removed from the string of lights, they are stored on the compartments in the top of the organizer. Other accessories such as clips or ornament hangers can also be stored in the compartment. When the desired lights and accessories have been stored within the organizer, the top is closed and the locked secured and it is placed in storage until the next holiday season. When the next holiday season arrives, the lights can be quickly removed from the spools and installed on the tree, etc., without the messy entanglement that accompanies storing the lights loosely.

The invention is not limited by the embodiments described above which are presented as examples only, but can be modified in various ways within the scope of protection defined by the appended patent claims.

Thus, while there have been shown and described and pointed out fundamental novel features of the invention as applied to currently preferred embodiments thereof, it will be understood that various omissions and substitutions and changes in the form and details of the method and apparatus illustrated, and in their operation, may be made by those skilled in the art without departing from the spirit of the invention. In addition it is to be understood that the drawings are not necessarily drawn to scale but that they are merely conceptual in nature. It is the intention, therefore, to be limited only as indicated by the scope of the claims appended herewith.

What I claim and desire to protect by Letters Patent is:

1.) A storage container having a bottom section and an upper section, said bottom section comprising:

a base and a plurality of walls extending upwardly from said base, each wall having a bottom edge positioned adjacent to and connected to said base, and having side edges which are in juxtaposition to side edges of other walls to form a rectangular shaped cavity in combination with said base, each said side edges of said walls being fixedly attached to side edges juxtaposed thereto and each having a top edge, said walls and base so formed to envelope a storage volume in the interior of said bottom section;

said upper section having walls that correspond to in the shape of and contact said top edge of said bottom section;

said bottom section and said upper section being affixed to each other by hinged means along a common side of one of said upper section and said bottom section to allow the upper section to close over and be fixed to said bottom section, there being means for securing said upper section to said bottom section;

within the interior of said bottom section, a plurality of stationary storage posts which extend upwardly from said base of said bottom section, each said storage post accommodates a plurality of spools around which flexible wire filaments are wrapped; said spools have a core diameter which allows one or more of them to be stored on said storage post;

one side of said walls of said bottom section having a vertical slit comprising two edges fitted with guide means, said vertical slit allowing direct passage from said interior of said bottom section to the outside and vice versa;

and a retrieving post having a rotatable base positioned diametrically opposite said vertical slit which also accommodates a spool and is used to receive a rotating spool while a flexible wire filament is wound up on said spool as a result of rotating said spool on said rotatable base, said wire having been wound on said spool as it was extended from said outside through said vertical slit onto said spool.

2. The storage container defined in claim 1 wherein said upper section contains one or more storage compartments that are accessible from the external top of said upper section.

3. The storage container defined in claim 2 wherein said spool on said storage post mounted on said rotatable base, contains an aperature at the top used in combination with a cranking handle to wind said filament about said spool.

4. The storage container contained in claim 3 wherein said rotatable base contains an opening configured to receive locking means positioned on the bottom of a spool on said rotatable storage post.

* * * * *